US010524975B2

(12) United States Patent
Clapp et al.

(10) Patent No.: US 10,524,975 B2
(45) Date of Patent: Jan. 7, 2020

(54) AIR VEST

(71) Applicant: RespirTech Technologies, Inc., St. Paul, MN (US)

(72) Inventors: Robert W. Clapp, Minneapolis, MN (US); Brandon L. Peterson, St. Paul, MN (US)

(73) Assignee: Koninklijke Philips N.V., Eindhoven (NL)

( * ) Notice: Subject to any disclaimer, the term of this patent is extended or adjusted under 35 U.S.C. 154(b) by 626 days.

(21) Appl. No.: 13/850,286

(22) Filed: Mar. 25, 2013

(65) Prior Publication Data

US 2013/0289455 A1 Oct. 31, 2013

Related U.S. Application Data

(60) Provisional application No. 61/615,008, filed on Mar. 23, 2012.

(51) Int. Cl.
*A61H 9/00* (2006.01)

(52) U.S. Cl.
CPC ..... *A61H 9/0007* (2013.01); *A61H 9/005* (2013.01)

(58) Field of Classification Search
CPC ..... A41D 1/04; A41D 27/02–06; A41D 2400/14; A61H 9/00–0007; A61H 9/005–0078; A61H 2031/003; A61H 2201/0103; A61H 2201/1619–1621; A61H 2201/165–1652; A61H 2201/5056; A61H 2201/084; A61H 2201/1238
See application file for complete search history.

(56) References Cited

U.S. PATENT DOCUMENTS 5,207,635 A * 5/1993 Richards ..... A61F 5/028 128/876
6,007,528 A * 12/1999 Osborn, III ..... A61F 13/4702 604/368
6,916,298 B2 * 7/2005 VanBrunt ..... A61B 10/0045 601/41
2008/0294075 A1 * 11/2008 Nozzarella ..... A61H 9/0078 601/44
2009/0227919 A1 * 9/2009 Nardi ..... A61H 9/0092 601/151
2010/0006614 A1 * 1/2010 McLean ..... A45C 11/00 224/577

* cited by examiner

*Primary Examiner* — Rachel T Sippel
(74) *Attorney, Agent, or Firm* — Michael W. Haas

(57) ABSTRACT

An air vest for supplying successive percussive forces to a patient during a therapy session is described. The air vest includes an air bladder and at least one belt for securing the vest to a patient, with the vest adapted to engage at least a portion of the thoracic region of the patient. The vest may define an inner surface, an outer surface, and one or more extension portions for controlling movement of the inner and outer surfaces relative to each other along at least a portion of the vest. Securement and fitting of the vest to the patient may be achieved with a plurality of releasable straps.

26 Claims, 7 Drawing Sheets

PRIOR ART

PRIOR ART

PRIOR ART

PRIOR ART

OPEN POSITION

CLOSED POSITION

AIR VEST

RELATED APPLICATIONS

This application claims the benefit of U.S. Provisional Application Ser. No. 61/615,008, filed Mar. 23, 2012, which is incorporated by reference herein in its entirety.

TECHNICAL FIELD

The present invention relates to oscillatory chest compression devices and more particularly to improved air vest devices for an air pulse system.

BACKGROUND OF THE INVENTION

A variety of high frequency chest compression ("HFCC") systems have been developed to aid in the clearance of mucus from the lung. Such systems typically involve the use of an air delivery device, in combination with a patient-worn vest. Such vests were developed for patients with cystic fibrosis, and are designed to provide airway clearance therapy. The inflatable vest is linked to an air pulse generator that provides air pulses to the vest during inspiration and/or expiration. The air pulses produce transient cephalad air flow bias spikes in the airways, which move mucous toward the larger airways where it can be cleared by coughing. The prior vest systems differ from each other, in at least one respect, by the valves they employ (if any), and in turn, by such features as their overall weight and the wave form of the air produced.

SUMMARY OF THE INVENTION

The present invention is directed to an improved vest device for a chest compression apparatus for applying a force to the thoracic region of the patient. The force applying mechanism includes the vest for receiving pressurized air from a remote pulse generator. The apparatus further includes a mechanism for supplying pressure pulses of pressurized air to the vest. The pressure pulses may have various different waveforms, such as, but not limited to, a sinusoidal waveform, a triangular waveform, and a square wave form. The apparatus provides a variety of solutions and options to the treatment problem faced by people having cystic fibrosis. The advantages of the invention relate to benefits derived from a treatment program using the present apparatus rather than a conventional device having a rotary valve and corresponding pulses. In this regard, a treatment program with the present apparatus provides a cystic fibrosis patient with independence in that the person can manipulate, move, and operate the machine alone. He/she is no longer required to schedule treatment with a trained individual. This results in increased psychological and physical freedom and self esteem. The person becomes flexible in his/her treatment and can add extra treatments, if desired, for instance in order to fight a common cold. An additional benefit is the corresponding decrease in cost of treatment, as well as a significant lessening of the weight (and in turn, increased portability) of the device itself.

An improved vest in accordance with the present invention includes an extension portion defined along a lower portion of the vest, wherein in at least one embodiment the extension portion is generally uninflated during a treatment program. By remaining uninflated, the extension portion tends to retain the vest in a desired orientation, as compared to prior art vests having fully inflated lower portions which tend to "roll" or "curl over" causing the vest to move away from a desired position and/or resulting in a decreased efficiency of the apparatus. The extension portion may be defined by a linear sewing of the upper and lower panels of the vest. The sew line effectively prevents the extension portion from inflating under pressure from the air source during a treatment program. The extension portion may be integrated into the upper and lower vest panels or may be a separate component secured to a lower vest edge during vest manufacture.

Another improved vest in accordance with the present invention includes an alternative securement approach for securing the vest to the patient. In one embodiment, securement and fitting of the vest to the patient is achieved with a plurality of releasable straps. Hook-and-loop fasteners (e.g., VELCRO brand fasteners) can be used to releasably secure ends of the straps to the vest. Releasable clasps and a fitting structure can also be included to allow the vest to be property fitted to the patient and quickly removed without releasing the hook and loop fasteners.

The present invention is also directed to a method of applying pressure pulses to the thoracic region of a patient, including positioning a vest having an air bladder and an extension portion at the thoracic region of the patient, with the extension portion controlling movement of a lower portion of the vest so as to minimize curl or roll of the vest during a treatment program. The method may also include coupling the air bladder to a pressurized air line via a multi-port air chamber, and coupling the air bladder to a vent line via the multi-port air chamber.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
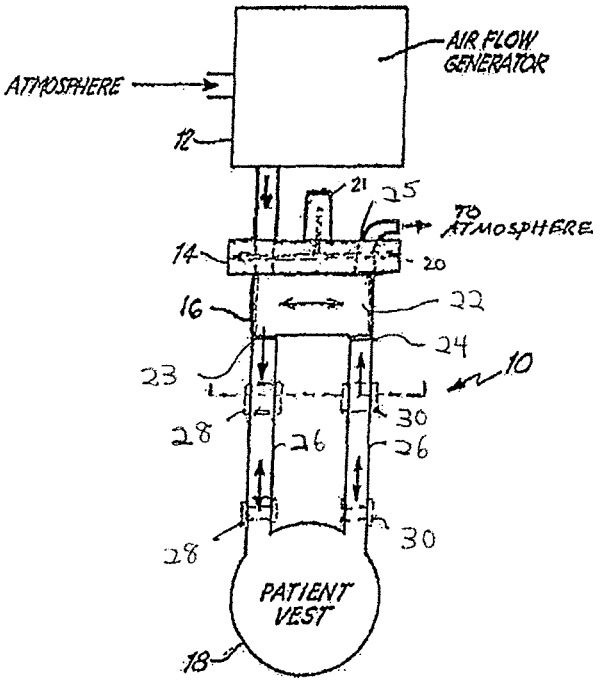
FIG. 1 is a depiction of functional aspects of an air system of the prior art, which may be used in conjunction with a vest of the present invention.

The present invention is directed to an air vest to be used as part of a chest compression system. An example of a suitable chest compression system is described in U.S. Pat. No. 8,192,381, issued to Nozzarella and entitled "Air Vest for Chest Compression Apparatus," the contents of which are hereby incorporated by reference in their entirety. An embodiment of the chest compression system described in U.S. Pat. No. 8,192,381 is referenced herein by the numeral 10. FIG. 1 shows an air flow diagram associated with system 10. System 10 includes an air flow generator component 12, flowably connected to a pulse frequency control module 14, which in turn is flowably connected to a pressure control device 16, and finally to a vest 18 worn by the patient. The patient may be a human or other animal. For example, both human and equine applications may be practicable, with differently sized vests 18 being defined by the particular applications. In use, the air flow generator (e.g., motor driven blower) delivers pressurized air to vest 18. The pressurized air is delivered via pulse frequency control unit 14 that preferably includes one or more rotating (e.g., fan-like) blades, such as circular valve blade 20, which is rotatable upon a central axis of motor 21. Air flow generator 12 includes an electric blower, the speed of which may be fixed or variable depending on an application.

Pressure control unit 16 defines a balancing chamber 22 in air communication with ports of module 14. Chamber 22 is adapted to receive or pass air through the ports of pulse frequency control module 14, and effectively provides a manifold or air chamber to deliver air to vest 18 or atmosphere by means of vest exit ports 23, 24 and atmosphere exit port 25. Air chamber 22 of pressure control unit 16 provides fluid communication between ports 23, 24 and 25, and hence fluid communication between the ports of pulse frequency control module 14 and air lines 26 to patient vest 18.

Pulse pressure control 16 is located between frequency control module 14 and vest 18 worn by the patient. In the illustrated embodiment, air chamber 22 is immediately adjacent pulse frequency control module 14. In one preferred embodiment, a structure defining the air chamber is directly connected to the outlet ports of the pulse frequency control module 14. The manifold or air chamber 22 provides fluid communication between air lines 26 extending to vest 18 and the bladder-side ports of the pulse frequency control module 14. Pressure control unit 16 may be active or passive. For example, an active pressure control unit may include, for example, valves and electric solenoids in communication with an electronic controller, microprocessor, etc. A passive pressure control unit 16 may include a manual pressure relief or, in a simple embodiment, pressure control unit 16 may include only the air chamber providing air communication between the air lines extending to the vest 18 and not otherwise including a pressure relief or variable pressure control.

System 10 further includes a plurality of quick connect air couplings 28, 30 which couple vest 18 with system 10 components within a housing via air hoses 26. Each quick connect air coupling 28, 30 includes male and female portions and a latch or other release for quickly disconnecting the portions. The benefits of the quick connect air couplings include minimization of inadvertent air hose disconnects and improved freedom of movement as the locking air coupling permit rotation between the air hose and the vest or air generator.

Figure 2:
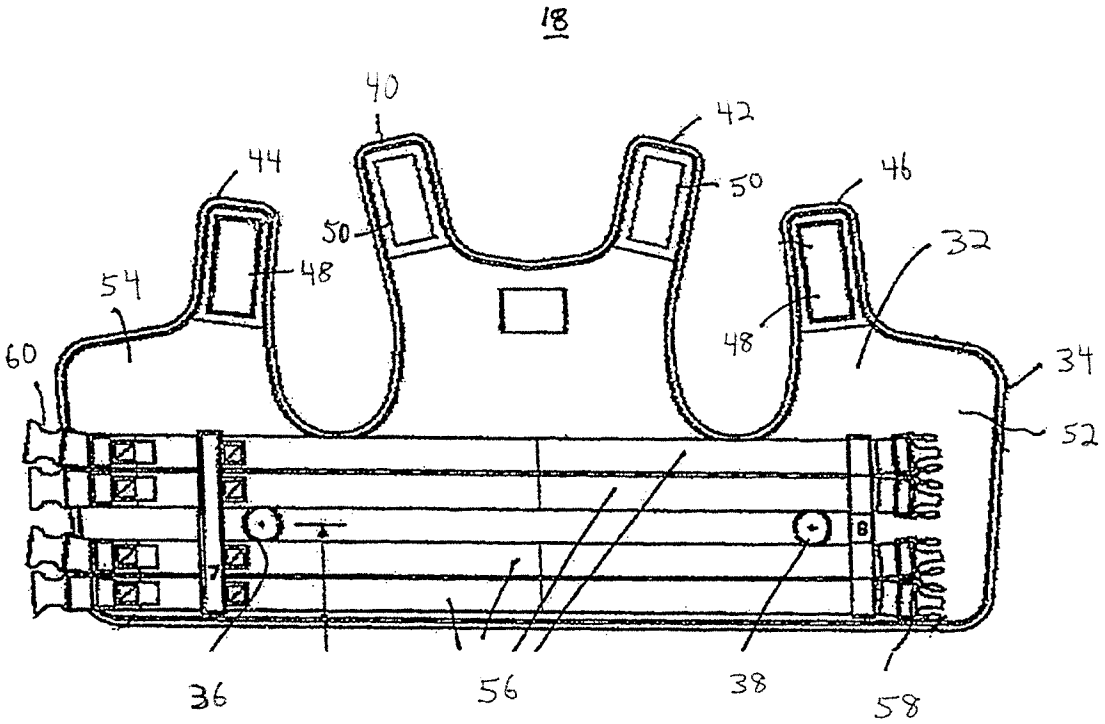
FIG. 2 is a top view of a patient vest of the prior art.

Vest 18 is utilized to provide high frequency chest wall oscillations or pulses to enhance mucus clearance in a patient with reduced mucociliary transport. Vest 18 is adapted to be located around the patient's upper body or thorax and supported at least partially on the patient's shoulders. Vest 18 is expanded into substantial surface contact with the exterior of the patient's upper body to apply repeated pressure pulses to the patient. FIG. 2 shows an embodiment of vest 18 depicted in U.S. Pat. No. 8,192,381. In this embodiment, vest 18 has an outside cover 32 comprising a non-elastic material, such as nylon fabric. Other types of materials can be used for cover 32. Cover 32 is secured to a flexible inside liner 34 located adjacent and around patient's body. An air core or bladder having an internal air chamber and a pair of air receiving ports 36, 38 is defined between cover 32 and liner 34.

Vest 18 has a pair of upright shoulder straps 40 and 42 laterally separated with a concave upper back edge. Upright front chest portions 44 and 46 are separated from straps 40 and 42 with concave curved upper edges which allow vest 18 to fit under the patient's arms. Releasable fasteners, such as loop pads 48 cooperated with hook pads 50 secured to the insides of shoulders straps 40 and 42 to releasably secure shoulder straps 40 and 42 to chest portions 44 and 46. Vest 18 has a first lateral end flap 52 extending outwardly at the one side of the vest. A second lateral end flap 54 extends outwardly from the other side of the vest 18.

A plurality of elongated straps 56 are utilized to secure the vest 18 to the patient. Straps 56 each include a releasable connector, such as male and female release buckles 58, 60. Female buckle 60 may be a side contoured buckle. The strap end may pass through the male release buckle 58 and may include a web stop formed by folding the strap end over. Adjustments of strap length may be made by pulling or releasing a strap portion through male release buckle 58. In the embodiment of FIG. 2, straps 56 generally encircle the patient.

Figure 3:
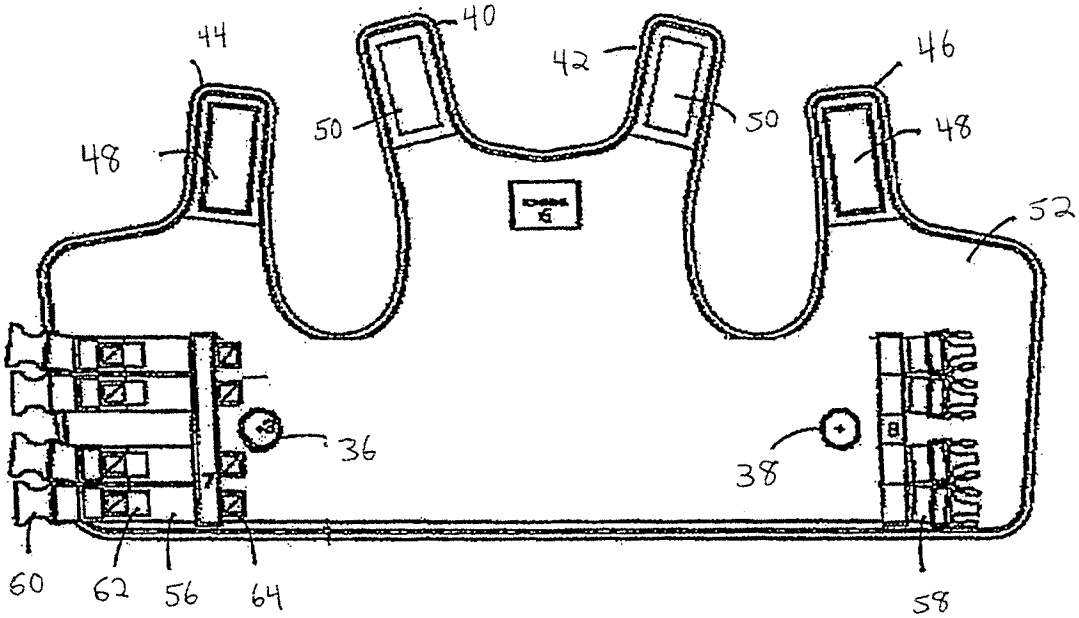
FIG. 3 is a top view of another embodiment of a patient vest of the prior art.
Figure 4:
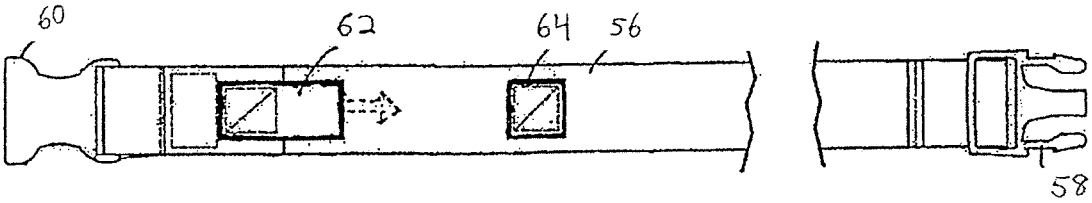
FIG. 4 PRIOR ART
FIGS. 4-7 illustrate functional aspects of a strap sizing feature of the prior art, which facilitates the proper fitting of patient vests.
Figure 5:
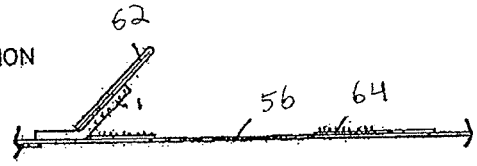
FIG. 5 PRIOR ART

Another embodiment of vest 18 disclosed in U.S. Pat. No. 8,192,381 is depicted in FIG. 3. In the embodiment of FIG. 3, straps 56 are secured proximate to the vest 18 front and do not otherwise encircle the patient. Instead forces to secure the vest to the patient are transferred directly to the vest 18 rather than indirectly via compression of the jacket by tightened straps 56 as in FIG. 2.

Figure 6:
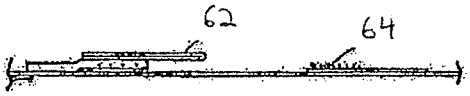
FIG. 6 PRIOR ART
Figure 7:
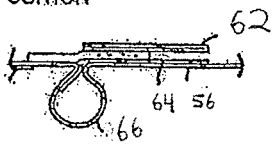

Each strap 56 includes a fitting device which assists in proper fitting of vest 18 to a particular patient. Referring to FIGS. 4-7, as disclosed in U.S. Pat. No. 8,192,381, free tab ends 62 are initially positioned directly above marker 64 so that an underlying loop material can engage a corresponding hook structure. Each of the straps 56 are initially provided in this so called "Closed Position" or pre-therapy position as shown in FIG. 7. The user then dons the vest 18 and the straps 56 are secured via couplings 58, 60 so as to be lightly snug against the patient's chest. Tabs 62 are then released and resecured into a therapy position as indicated in FIG. 6. As a result of the release, an additional length of strap 56 material (length of loop 66) is provided to the user permitting slight release of the vest from the patient and otherwise providing a desired level of snugness to the vest against the user's chest. This fitting device thus permits a quick approach to an optimum sizing of the vest. In the absence of such a device, either the vest is often too snug against the chest or too loose. In either case, device performance is compromised.

HFCC therapy is prescribed as either an adjunct or outright replacement for manual chest physiotherapy. Total therapy time per day varies between about 30 minutes and about 240 minutes spread over one to four treatments per day. Patients can be instructed in either the continuous intermittent mode of HFCC therapy, which may include continuous use of aerosol.

During HFCC therapy the patient sits erect, although leaning against a chair back is acceptable as long as air flow in the vest is not restricted. In the continuous mode, the patient operates the vest for 5 minutes at each of six prescribed frequencies (determined by "tuning" performed during a clinic visit). The patient uses the hand control to stop pulsing as frequently as necessary to cough, usually every several minutes.

In the intermittent mode, the patient uses the hand control to stop pulsing during inspiration to make it easier to inhale maximally. The pulsing is activated again during each expiration. Longer pauses for coughing are taken as needed. The patient goes through the cycle of prescribed frequencies determined by tuning during a clinic visit.

The vest may be "tuned" for each individual to determine the volume of air expressed from the lung and the rate of flow of this air for each chest compression frequency (e.g., from about 5 Hz to about 22 Hz). The flow rates and volume are calculated with a computer program from flow data obtained during tidal breathing through a Hans Rudolph pulmonary pneumotachometer with pinched nose. The frequencies associated with the highest flow rates are usually greater than 13 Hz, while those associated with largest volume are usually less than about 10 Hz. These best frequencies vary from patient to patient. Since the highest induced flow rates usually do not correspond with largest induced volumes, and since 2 to 3 were commonly very close in value, the three highest flow rates and the three largest volumes are selected for each patient's therapy. Occasionally one frequency is selected twice because it produces one of the three highest flow rates and one of the three largest volumes. Each of these six frequencies may be prescribed for five minutes for a total of 30 minutes each therapy session. Since the best frequencies change over time with the use of the vest, re-tuning should be performed every 3 to 6 months.

One explanation of the way in which HFCC moves mucus is derived from observations of the perturbations of air flow during tidal breathing and during maximum inspiration and exhalation to residual volume. Each chest compression produces a transient flow pulse very similar to the flow observed with spontaneous coughing. Tuning identifies those transient flows with the greatest flows and volumes, in effect the strongest coughs, and analogously with the greatest power to move mucus in the airways.

Figure 8:
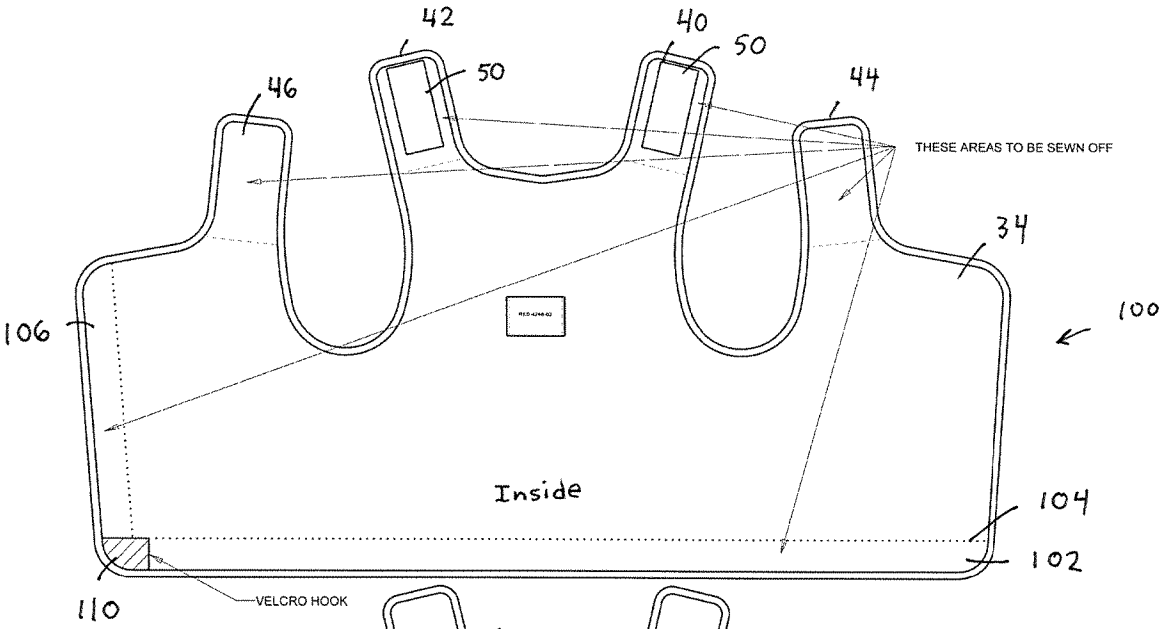
FIG. 8 is a top view of an inner panel portion of a vest according to one embodiment of the present invention.
Figure 9:
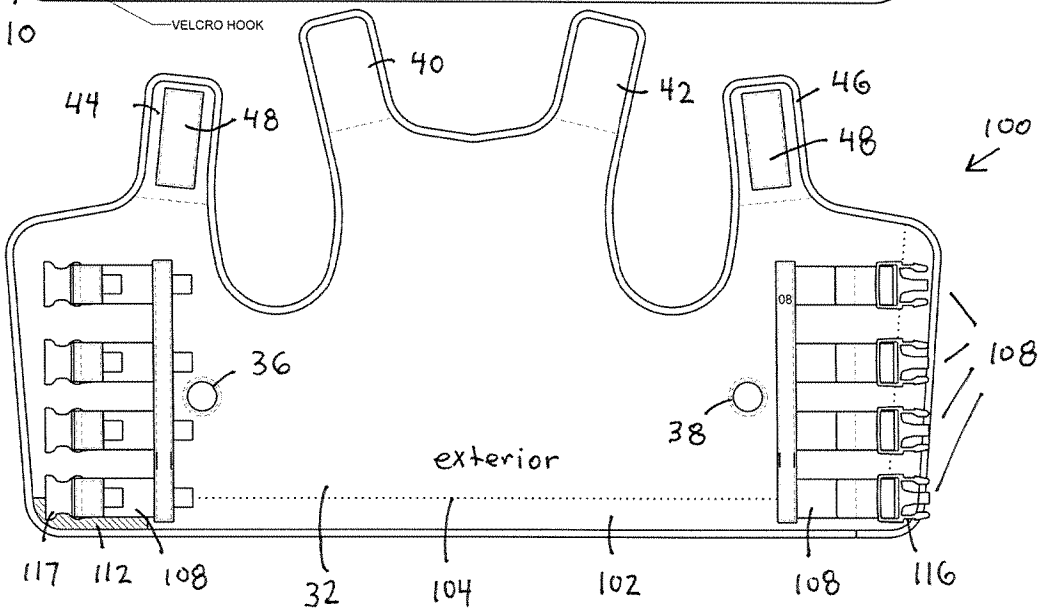
FIG. 9 is a top view of an outer panel portion of the vest of FIG. 8.

Referring now to FIGS. 8-9, an improved vest 100 of the present invention includes an extension portion 102 defined along a lower portion of the vest. An air core or bladder having an internal air chamber and a pair of air receiving ports 36, 38 is defined between cover 32 on the outside of the vest 100 and liner 34 on the inside of the vest. Extension portion 102 is generally uninflated during a treatment program. By remaining uninflated, the extension portion 102 tends to retain the vest 100 in a desired orientation, as compared to prior art vests having fully inflated lower portions which tend to "roll" or "curl over" causing the vest to move away from a desired position and/or resulting in a decreased efficiency of the apparatus. The extension portion 102 may be defined by a linear sewing of the cover 32 and liner 34 of the vest. A sew line 104 effectively prevents the extension portion 102 from inflating under pressure from the air source during a treatment program.

The sew line 104, while shown as being linear in form, may be curved or otherwise shaped in alternative embodiments. Also, the sew line 104, while shown as being generally parallel to the lower edge of the vest 100, may be oriented in a manner such that it is not parallel to the lower edge of the vest in alternative embodiments.

In one embodiment, the sew line 104 may be located approximately two (2) inches from the lower edge of the vest 100. However, in alternative embodiments, the sew line may be located a variety of distances from the lower edge of the vest.

Further areas of vest 100, besides extension portion 102, may be defined by sewing the cover 32 to the liner 34 of the vest. As shown in FIGS. 8-9, these areas may include, for example, a side portion 106, shoulder straps 40 and 42, and front chest portions 44 and 46.

Vest 100 includes shoulder straps 40 and 42 and releasable fasteners, such as loop pads 48 cooperating with hook pads 50 secured to the inside of shoulder straps 40 and 42. In alternative embodiments of the present invention, the vest may not include shoulder straps 40 and 42, and may therefore be shoulder-less.

In the vest 100, rear strap portions 56 are removed (as compared with the prior art vest of FIG. 2) and replaced with relatively short straps 108. A plurality of straps 108 are utilized to secured the vest 100 to the patient. Straps 108 each include a releasable connector, such as male and female release buckles 58, 60. Female buckle 60 may be a side contoured buckle.

VELCRO brand hook-and-loop fasteners may be used to releasably secure sides of the vest 100 together at the lower edge of the vest. As shown in FIG. 8, a hook portion 110 of the hook and loop fastener system may be provided at a side of the lower edge of the vest 100. As shown in FIG. 9, the loop portion 112 of the hook and loop fastener system is then provided on the other half of vest 100.

In the vest 100, the extension portion 102 is designed to remain uninflated during application of pressurized air into the vest 100. Vest 100 has improved patient performance as compared to prior vest versions as the tendency of the lower portion of vest 100 to roll or curl over is greatly reduced. The extension portion 102 may be defined by sewing the cover 32 and liner 34 (i.e. the upper and lower fabric panels of the vest 100) together. Alternatively, a separate extension portion 102 could be sewn or otherwise secured to the lower portion of the vest 100. The separate extension portion 102 (not shown) could be made of different materials as compared to the panels of the vest 18. The extension portion 102 need not comprise a cover 32 and liner 34 (i.e. upper and lower panel segments). In an alternative design, extension portion 102 could be a single ply material which is sewn or otherwise connected to the lower portion of vest 100. The single ply material may be substantially more rigid than the upper ply forming the cover 32 and lower ply forming the liner 34 of the vest. In yet another design, the extension portion 102 could be defined by relatively stiff material that could be inflated during a treatment program. For example, a relatively stiff insert could be secured to the upper or lower panel of vest 100, with the insert tending to resist roll-up or curl-over of the lower edge of the vest 100 during a treatment program. It is envisioned that alternative structures, either incorporated into the vest panels or otherwise secured to the vest, could be used to eliminate or minimize the tendency of a vest to curl or roll upon application of repeated air pulses.

Figure 10:
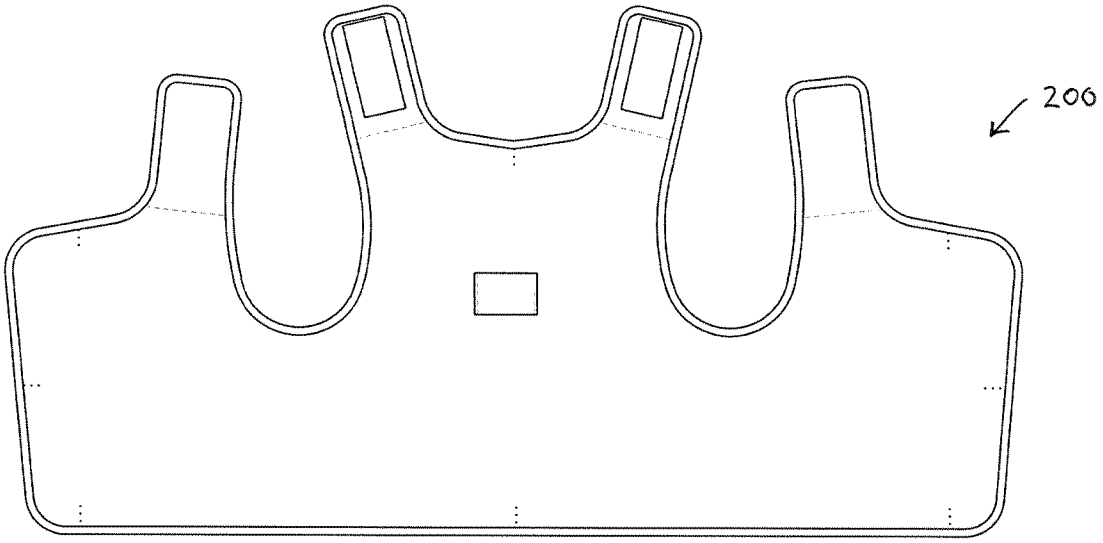
FIG. 10 is a front and back view of a second vest embodiment of the present invention.
Figure 11:
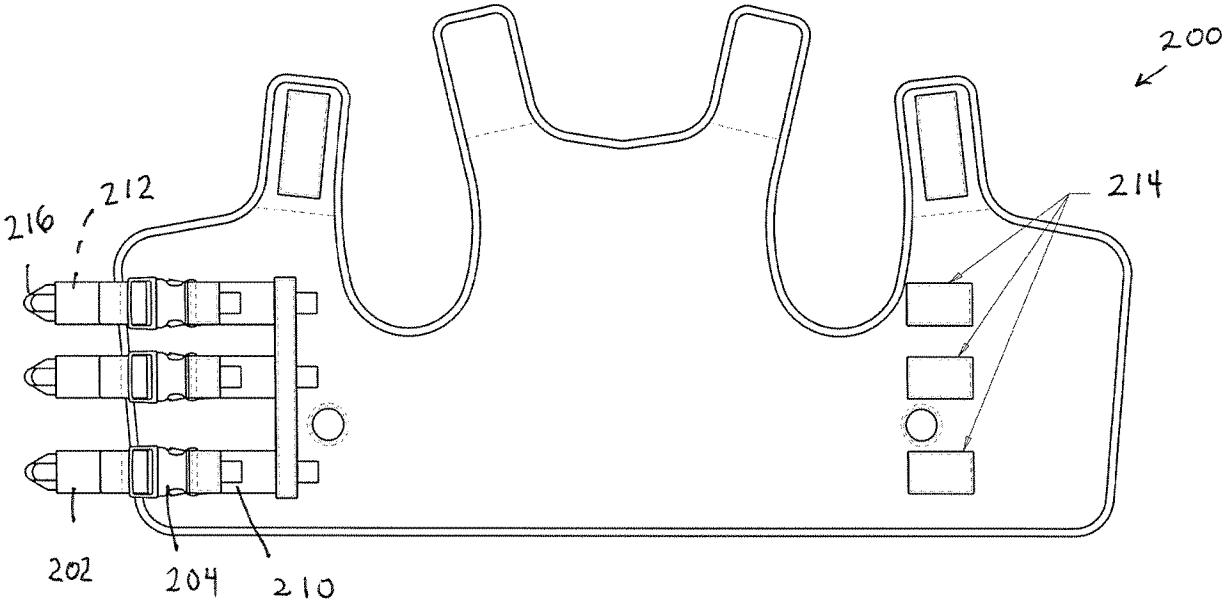
FIG. 11 is a back view of the vest of FIG. 10.

Referring now to FIGS. 10-11, another improved vest 200 in accordance with the present invention includes an alternative securement approach for securing the vest 200 to the patient. In one embodiment, securement and fitting of the vest to the patient is achieved with a plurality of releasable straps 202. VELCRO brand hook-and-loop fasteners can be used to releasably secure ends of the straps 202 to the vest 200. Releasable clasps 204 and a fitting structure 210 (such as the fitting structure described above in connection with FIGS. 4-7) can also be included to allow the vest 200 to be property fitted and quickly removed. Hook portions 212 of the hook and loop fastener system may be provided at ends of the straps 202, with the other end being secured to the vest 200. The loop portions 214 of the hook and loop fastener system are provided on the other half of vest 200. Vest 200 can be removed by releasing the clasps 204 or by disengaging the hook and loop fasteners, such as by pulling on loops 216 proximate to the hook portions 212.

Figure 12:
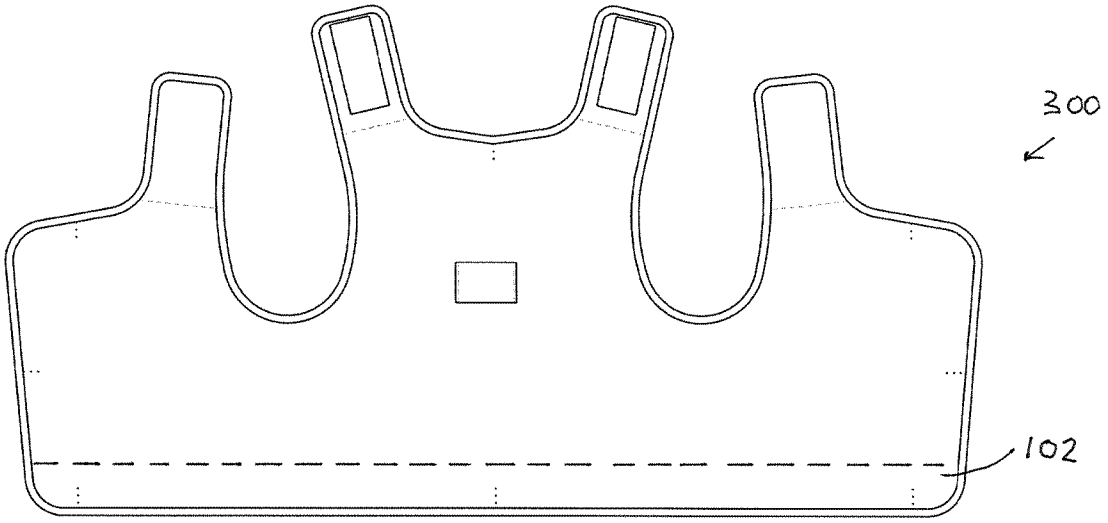
FIG. 12 is a front and back view of a third vest embodiment of the present invention.
Figure 13:
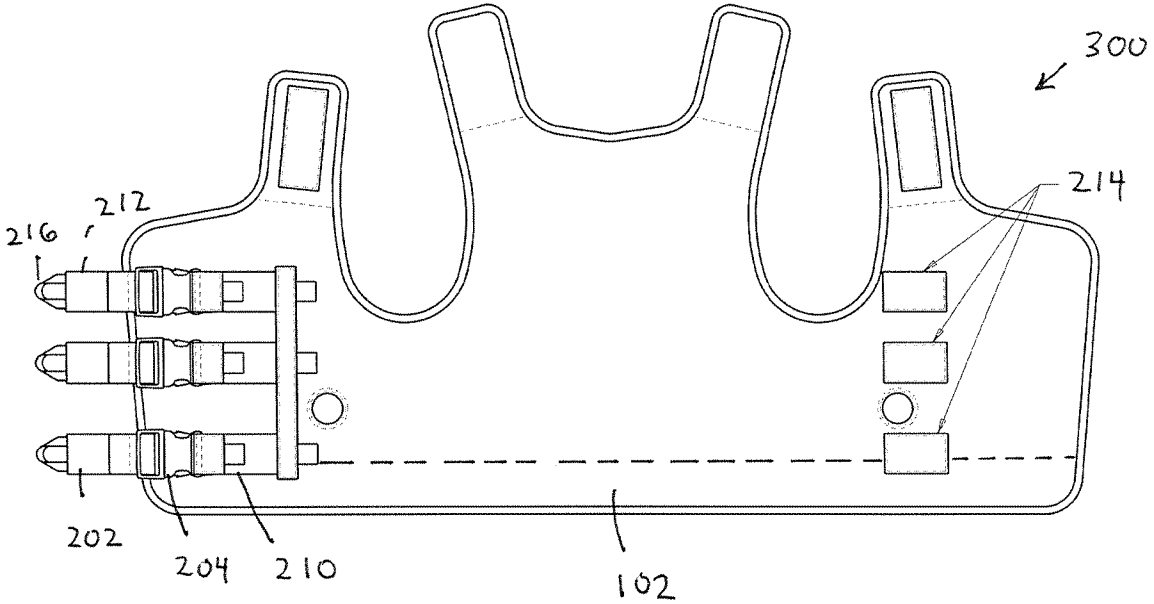
FIG. 13 is a back view of the vest of FIG. 12.

FIGS. 12-13 show another embodiment of the present invention, depicted as vest 300. Vest 300 includes the features of both vest 100 and vest 200. By having both the extension portion 102 and the releasable clasps 204, fitting structure 210, and releasable straps 202, patient fitting and compliance may be improved. The vest 300 can be removed either by releasing the mechanical clasps 204 or releasing the hook and loop fasteners securing one end of the straps 202 to the vest 300.

The vest of the present invention may be used with air pulse generating devices such as, but not limited to, the air pulse generating device disclosed in U.S. Pat. No. 8,182,381. It is envisioned that the improved vest of the present invention could be used with a variety of commercially available air pulse generators.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A chest compression apparatus comprising:

a vest adapted to engage at least a portion of a thoracic region of a patient, the vest comprising:

an outer surface panel configured to encircle the patient's thoracic region;

an inner liner coupled to the outer surface panel;

an air bladder arranged between the outer surface panel and the inner liner;

at least one strap for securing the vest to the patient; and an extension portion for controlling movement of the outer surface panel and inner liner relative to each other along a lower edge of the vest during use, the extension portion arranged between a sew line and the lower edge of the vest and encircling the patient's thoracic region when the vest is worn, wherein the extension portion remains effectively uninflated during a treatment and has a length extending between the sew line and the lower edge of the vest, the length configured to prevent the lower edge of the vest from rolling or curling during a treatment; and wherein the extension portion comprises a fastener located between the sew line and the lower edge configured to couple a first side of the extension portion to a second side of the extension portion when the vest is worn by the patient; and a source of pressurized air in communication with said air bladder.

2. The chest compression apparatus of claim 1 wherein the extension portion is defined by sewing the outer surface panel and inner liner of the vest together.

3. The chest compression apparatus of claim 1, wherein the at least one strap is user-adjustable to facilitate proper fitting of said vest upon the patient, with said strap comprising:

a releasable mechanical clasp; and a hook and loop-type fastener; wherein the hook and loop-type fastener is configured to releasably couple an end of the at least one strap to the vest such that the vest is configured to be released from the patient by releasing the mechanical clasp, or by disengaging the hook and loop-type fastener.

4. The chest compression apparatus of claim 1, wherein the extension portion comprises a separate element secured to a lower portion of the vest.

5. The chest compression apparatus of claim 1, wherein the extension portion is a single ply element secured to the outer surface and the inner lining of the vest, the extension portion comprising a different material relative to one or more materials that form the outer surface and the inner liner of the vest.

6. The chest compression apparatus of claim 1, wherein the extension portion is uninflatable.

7. The chest compression apparatus of claim 1, wherein the fastener of the extension portion is located only between the sew line and the lower edge of the vest.

8. The chest compression apparatus of claim 1, wherein the sew line is located approximately two inches from the lower edge of the vest.

9. A method of applying pressure pulses to a thoracic region of a patient comprising the steps of:

positioning a vest at the thoracic region of the patient, so as to encircle the thoracic region, the vest comprising:

an air bladder; and an extension portion controlling movement of a lower portion of the vest so as to reduce or prevent curl or roll of the vest during a treatment program, with said extension portion arranged between a sew line and a lower edge of the vest and encircling the patient's thoracic region, wherein the extension portion remains effectively uninflated during application of the pressure pulses and has a length extending between the sew line and the lower edge of the vest, the length configured to reduce or prevent the curl or roll of the lower edge of the vest during the treatment program, wherein the extension portion comprises a fastener located between the sew line and the lower edge configured to couple a first side of the extension portion to a second side of the extension portion when the vest is worn by the patient;

coupling the air bladder to a pressurized air line via a multi-port air chamber; and coupling the air bladder to a vent line via said multi-port air chamber.

10. The method of claim 9, wherein the extension portion is integrated into an outer surface panel and an inner liner of the vest.

11. The method of claim 10 wherein the extension portion is defined by sewing the outer surface panel and inner liner of the vest together.

12. The method of claim 9, wherein the extension portion comprises a separate element secured to a lower portion of the vest.

13. The method of claim 12, wherein the extension portion is a single ply element secured to the outer surface and the inner liner of the vest, the extension portion comprising a different material relative to one or more materials that form the outer surface and the inner liner of the vest.

14. The method of claim 13 wherein the single ply element is substantially more rigid than each of the outer surface panel and inner liner of the vest.

15. The method of claim 9, wherein the extension portion is uninflatable.

16. The method of claim 9, wherein the fastener of the extension portion is located only between the sew line and the lower edge of the vest.

17. The method of claim 9, wherein the sew line is located approximately two inches from the lower edge of the vest.

18. The method of claim 9, wherein the vest further comprises at least one strap for securing the vest to the patient, said at least one strap comprising a releasable mechanical clasp; and a hook and loop-type fastener, wherein the hook and loop-type fastener is configured to releasably couple an end of the at least one strap to the vest, the method further comprising releasing the vest from the patient by releasing the mechanical clasp, or by disengaging the hook and loop-type fastener.

19. A chest compression apparatus comprising:

a vest adapted to engage at least a portion of a thoracic region of a patient, the vest comprising:

an outer surface panel configured to encircle the patient's thoracic region;

an inner liner coupled to the outer surface panel;

an air bladder arranged between the outer surface panel and the inner liner;

a strap for securing the vest upon the patient, an end of the strap being releasably secured to the vest via a hook and loop-type fastener component, the strap comprising a releasable mechanical clasp, wherein the vest is configured to be released from the patient by releasing the mechanical clasp, or by disengaging the hook and loop-type fastener; and an extension portion for controlling movement of the outer surface panel and inner liner relative to each other along a lower edge of the vest during use, the extension portion arranged between a sew line and the lower edge of the vest and encircling the patient's thoracic region when the vest is worn, wherein the extension portion remains effectively uninflated during a treatment and has a length extending between the sew line and the lower edge of the vest, the length configured to prevent the lower edge of the vest from rolling or curling during a treatment, and wherein the extension portion comprises a fastener located between the sew line and the lower edge configured to couple a first side of the extension portion to a second side of the extension portion when the vest is worn by the patient; and a source of pressurized air in communication with said air bladder.

20. The chest compression apparatus of claim 19 wherein the strap further comprises a loop for disengaging the hook and loop-type fastener.

21. The chest compression apparatus of claim 19 wherein the extension portion is defined by sewing the outer surface panel and the inner liner of the vest together.

22. The chest compression apparatus of claim 19, wherein the extension portion comprises a separate element secured to a lower portion of the vest.

23. The chest compression apparatus of claim 19, wherein the extension portion is a single ply element secured to the outer surface and the inner lining of the vest, the extension portion comprising a different material relative to one or more materials that form the outer surface and the inner liner of the vest.

24. The chest compression apparatus of claim 19, wherein the extension portion is uninflatable.

25. The chest compression apparatus of claim 19, wherein the fastener of the extension portion is located only between the sew line and the lower edge of the vest.

26. The chest compression apparatus of claim 19, wherein the sew line is located approximately two inches from the lower edge of the vest.

* * * * *